United States Patent [19]

Stoody

[11] 4,431,119

[45] Feb. 14, 1984

[54] SELF-CLEANING, AEROSOL VALVE FOR SEPARATE FLUIDS

[76] Inventor: William R. Stoody, 8659 Summerdale Rd., San Diego, Calif. 92126

[21] Appl. No.: 323,123

[22] Filed: Nov. 19, 1981

[51] Int. Cl.[3] ..... B67D 5/56; B65D 83/00

[52] U.S. Cl. ..... 222/129; 222/145; 222/148; 222/402.18; 239/308

[58] Field of Search ..... 222/148, 402.18, 402.17, 222/402.1, 144.5, 145, 129, 635, 94, 402.24; 239/308, 337, 323, 353, 356, 369, 371

[56] References Cited

U.S. PATENT DOCUMENTS

| | | | |
|---|---|---|---|
| 3,319,894 | 5/1967 | Cooprider | 239/337 X |
| 3,326,469 | 6/1967 | Abplanalp et al. | 222/635 X |
| 3,341,082 | 9/1967 | Meshberg | 222/148 |
| 3,478,933 | 11/1969 | Rousselot | 222/635 |
| 3,581,946 | 6/1971 | Meshberg | 222/94 X |
| 3,583,604 | 6/1971 | Marand et al. | 222/635 |
| 3,589,618 | 6/1971 | Thornton et al. | 222/635 X |
| 3,592,359 | 7/1971 | Marrafino | 222/402.24 X |
| 3,704,814 | 12/1972 | Ruscitti | 222/402.24 X |
| 3,982,668 | 9/1976 | Riccio | 222/402.18 X |
| 4,311,256 | 1/1982 | DeArmitt | 222/402.17 X |

FOREIGN PATENT DOCUMENTS

| | | | |
|---|---|---|---|
| 468209 | 3/1969 | France | 239/308 |

*Primary Examiner*—Randolph Reese
*Assistant Examiner*—Russell D. Stormer

[57] ABSTRACT

This disclosure relates to a manually operated, self-cleaning, aerosol valve that is adapted to maintain separation of fluids while they are within the valve body. The valve is internally separated by a sealing gasket that cooperatively engages a valve seat, and an outwardly projecting discharge passageway stem member. When the valve is in a nonoperating state, engagement of the gasket with respect to the valve seat prevents discharge passage of a first fluid to the stem passageway, and engagement of the gasket with respect to the stem prevents discharge passage of a second fluid. In cofluid dispensing state, first and second ports into the stem discharge passageway are positioned on opposite sides of the gasket. This allows first and second fluids to separately enter the stem passageway, and maintains separation of fluids awaiting discharge. When the valve is operated in positions intermediate the shut and cofluid dispensing state, both first and second fluid ports are positioned to receive first fluid only. Thus, in intermediate operating positions of the valve, first fluid can purgingly pass through both fluid ports and stem passageway to effect self-cleaning, and separation of fluid awaiting discharge can still be maintained.

10 Claims, 8 Drawing Figures

SELF-CLEANING, AEROSOL VALVE FOR SEPARATE FLUIDS

RELATED APPLICATIONS

The present invention represents a modification of the valve in the applicant's co-pending patent application, Ser. No. 266,747 filed May 26, 1981, now U.S. Pat. No. 4,405,064.

BACKGROUND OF THE INVENTION

The development of water-borne spray paint has created the need for the present invention. Valves for water-borne paint must be capable of maintaining separation of propellant and paint. They must also be able to thoroughly purge residue from discharge passageway surfaces. Unlike other aerosol products, water-borne paints are not compatible with propellants in their liquefied state. Heretofore aerosol valves have allowed internal mixing of propellant and product, or they have failed to provide a suitable means for purging residue from the valve without internal mixing of propellant and product.

The present improved valve not only recognizes the need for a water-borne paint aerosol valve, but, it also recognizes the need to provide a valve that is economical. The Applicant's copending application mainly sought to fulfill the need for a water-borne paint aerosol valve.

PRIOR ART

S. Prussin's invention, U.S. Pat. No. 3,525,456 is the most comparable valve to the present invention, it employs a stationary valve seat and a flexible sealing means which can be engaged and disengaged to prevent or allow flow of first and second fluids. However, the Prussin invention does not provide for first and second fluid separation within the valve body when the valve is operated. Maintaining internal separation of the fluids is an essential requirement for water-borne paint aerosol valves.

R. F. Ewald's invention, U.S. Pat. No. 3,583,606 exemplifies the failure to adequately purge valves. The Ewald invention does provide for internal separation of first and second fluids, but, it fails to provide a means for removing residue from the second fluid discharge stem entrance port.

SUMMARY OF THE INVENTION

The present invention is a novel valve consisting of a first fluid transit chamber, and a lower second fluid transit chamber, which are separated by an annular flexible gasket. Within the upper chamber there is a valve seat that controls flow of a first fluid into discharge passageway ports provided in an outwardly projecting valve stem. The stem can be operated so that first and second fluid discharge ports are positioned within their respective chambers. Separation of the chambers is maintained by sealing engagement of the stem with respect to a central opening through the gasket.

It is an object of the present invention to provide an aerosol valve that is capable of maintaining separation of a first and second fluid prior to discharge.

Another object is to provide a valve that can be purged without mixing products awaiting discharge.

Another object is to provide valves through which propellant can be introduced for separate storage within an aerosol that has been prefilled with a product.

A further object is to provide an aerosol valve that utilizes propellant vapor as a means of inducing a fine spray mist from viscous fluid products that are incompatible with propellants in their liquefied state.

Still another object is to provide a valve that can maintain separation of first and second fluids until they have departed from the valve dispensing head.

These and other objects and advantages will be seen from the following specification in conjunction with the appended drawings. It will be understood that the specification and drawings are for the purpose of illustration and do not define the scope or limits of the invention. There are, of course, additional features of the invention that will be described hereinafter and which will form the subject of the claims appended hereto. Those skilled in the art will appreciate that the conception upon which this disclosure is based may readily be utilized as a basic for the designing of other structures for carrying out the several purposes of the invention. Therefore, the claims are intended to cover all of the generic and specific features of the invention, and all statements of the scope of the invention which, as a matter of language, might be said to fall therebetween.

THE DRAWINGS

FIG. 3 is an isometric view of a modification of the valve showing the inclusion of an operating position control member.

DETAILED DESCRIPTION OF THE INVENTION

Figure 1:
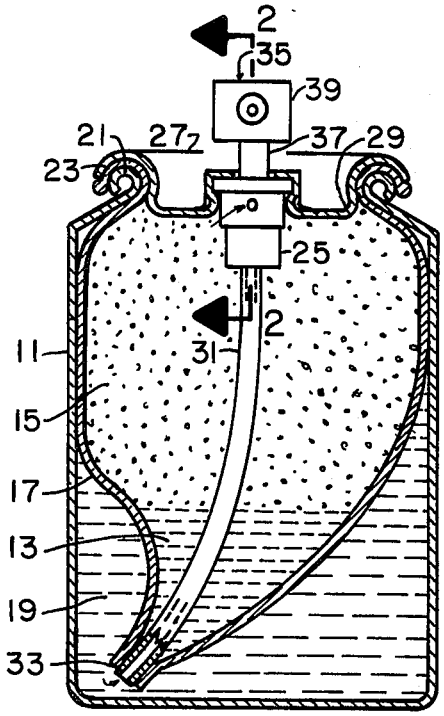
FIG. 1 is a cross-sectional view, depicting the valve of this invention typically installed on an aerosol container.

Referring now to the drawings, there cross sectionally depicted in FIG. 1, an aerosol container 11 of substantially conventional construction. Therein, a liquefied pressurizing propellant first fluid 13 and a first fluid vapor 15 are stored within an expansible inner container 17, and externally thereof a second fluid 19 is separately stored within container 11. Pressure exerted by first fluid 13 and vapor 15 is transferred through container 17 to the second fluid 19 providing an expulsion means for said second fluid.

Container 11 has at its top, an annular fill opening 21, and mated thereon an overlying fill opening 23 of inner container 17. A valve mechanism 25 which includes a unifier member, valve cup 27, is supported within said inner container opening 23. Valve cup 27 is affixed at designation 29 to effect sealing closure of containers 11 and 17.

A conduit 31 depending from valve mechanism 25 sealingly extends through a wall, at designation 33, of inner container 17 to establish a separate enclosed passageway through container 17 for isolated discharge flow of said second fluid 19 into valve mechanism 25.

Figure 2:
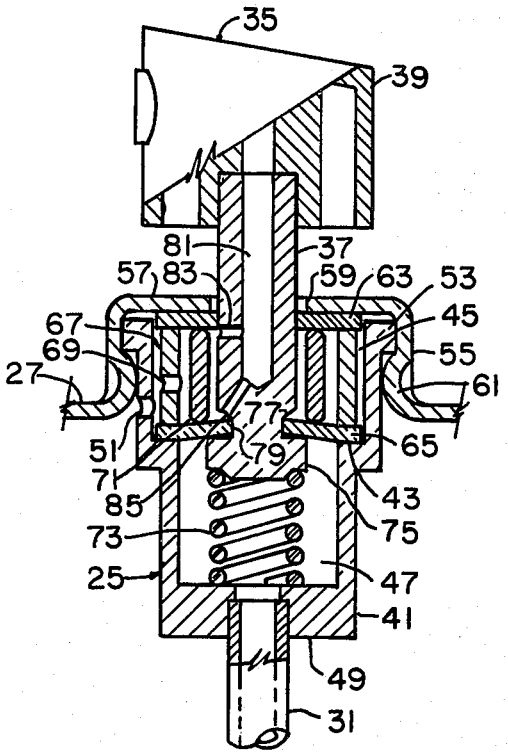
FIGS. 2, 3 and 4 are cross-sectional views taken along the lines 2—2 of FIG. 1, and illustrate the operational sequence of the valve.
Figure 4:
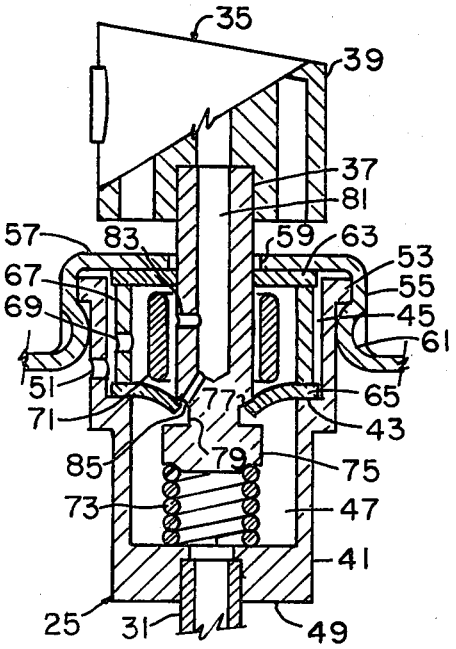
Figure 3:
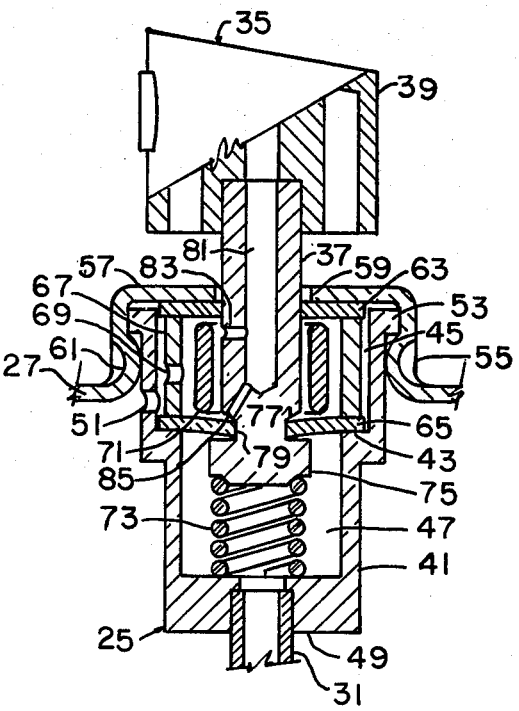

An operable dispensatory actuator means 35, having a tubular shaped stem 37, and mounted thereon a substantially conventional dispensing head 39, projects outwardly from valve mechanism 25 to provide a depressible means for valve operation. Head 39 is in cooperative dispensing communication with stem passageways, which will be described hereinafter, to effect three basic operation functions; a normally shut valve state, first function as shown in FIG. 2, whereby said actuator 35 is biased in its uppermost position to prevent discharge passage of fluids; a self-cleaning second intermediate function, as depicted in FIG. 3, whereby first fluid vapor 15 can be exhausted to purgingly expell second fluid residue without compromising the integrity of fluids awaiting discharge; then, as shown in FIG. 4, a fully open controlled discharge third function whereby, both first and second fluids can be concurrently dispensed while the integrity of fluids awaiting discharge continues to be maintained. The said functions are sequentially reversed when said actuator means is allowed to return to previously said shut state following operation. Thus, the intermediate self-cleaning function automatically occurs following cofluid dispensing.

Now referring to FIG. 2, valve mechanism 25 has a generally cylindrical open end housing 41 that is concentrically bored providing an inwardly extending annular ledge 43 which internally divides housing 41 into an upper first fluid transit chamber 45, and a lower second fluid transit chamber 47. Housing 41 is also provided with; a centrally apertured closure bottom 49 which is adapted to receive said conduit 31 and thereby permit second fluid entrance into second fluid transit chamber 47; at least one first fluid orifice 51 establishing first fluid communication from exterior of housing 41 to first fluid transit chamber 45; and an upper end annular brim 53 for attachment with said valve cup 27.

Annular brim 53 extends into a central protrusion 55 of valve cup 27 that includes a closure end 57 which in turn has at its center an annular opening 59. Therein, said brim 53 is securingly clamped by indented crimps 61 intermittently formed about the circumference of protrusion 55. Crimps 61 engage brim 53 in a manner that draws housing 41 toward closure end 57.

Confined within said first fluid transit chamber 45 are; a deflectable first sealing means gasket 63 and a deflectable second sealing means gasket 65, these are resilient washer-like annular discs, each having a central opening sized to sealingly engage said stem 37; an annular spacer sleeve 67 having opposite open ends, a central opening, and at least one perforation, designated 69, that is provided to extend unbiased communication for first fluid into the center of sleeve 67; and an annular valve seat member 71 which is a second annular sleeve without perforations.

Gasket 65, adjacent its periphery is engaged at one end of spacer 67 and sealingly secured between said spacer end and said ledge 43. Gasket 65 serves to provide a sealing barrier between said first and second fluid chambers 45 and 47, one side of gasket 65 being within chamber 45 and the second side being within chamber 47. Similarly gasket 63 is sealingly secured between the opposite end of spacer 67 and valve cup closure end 57, one side of gasket 63 being adjacent said closure end 57, and the second side being within chamber 45. The accumulated thickness of gaskets 63, 65 and spacer 67 is slightly greater than the distance from ledge 43 to the open end of housing 41, this assures that said gaskets 63 and 65 are sealingly clamped by affixing of housing 41 within valve cup protrusion 55.

Valve seat 71 is confined within the encirclement of spacer 67, and at its opposite ends valve seat 71 is in disengagable sealing engagement with interfacing surfaces of gaskets 63 and 65. The outer diameter of valve seat 71 is slightly less than the central opening diameter of spacer 67, this provides a space annulus between valve seat 71 and spacer 67, that is in communication with exterior of housing via orifice 51 and perforation 69. Valve seat 71 is also provided with a length slightly less than that of spacer 67 to allow upward deflection of a central portion of gasket 65.

Said actuator means 35 is held in its normally uppermost shut state, as shown in FIG. 2, by a compression spring 73 spanned between a closed, bottom flange 75 of stem 37, and housing 41 closure bottom 49. Spring 73 urges flange 75 upward against a central side surface portion of gasket 65. Correspondingly said central portion of gasket 65 is deflected upward causing the opposing side of gasket 65 to sealingly engage the adjacent end of valve seat 71, and subsequently the opposite end of valve seat 71 is sealingly pressed against gasket 63.

Stem 37 of actuator means 35 extends centrally upward from flange 75 passing through gaskets 63 and 65, valve seat 71, and said center opening 59 of valve cup 27, and projects outwardly from valve mechanism 25. Stem 37 is provided with an outer diameter which is constant through a substantial portion of its length, to provide slidable sealing engagement with said central opening of gasket 63. Said valve cup opening 59 is sized to provide free movement of stem 37, and central opening of valve seat 71 is sized to provide a space around stem 37. At said central opening of gasket 65, stem 37 has a tappered shoulder 77 that joins a reduced diameter neck 79 which is adjacent flange 75. The central opening of gasket 65 is in cooperative sealing engagement with neck 79 and shoulder 77. When the valve is operated for cofluid dispensing said shoulder 77 is sealingly projected through the said central opening of gasket 65 causing the central portion of gasket 65 to be deflected downward away from valve seat 71. Said projection of shoulder 77 is accommodated by the resilient nature of gasket 65.

Stem 37 is also provided with an open end longitudinal central discharge passageway bore 81, a first fluid passage port 83 into passageway bore 81, and a second fluid port 85 into the bottom of passageway bore 81. It is understood that the first fluid port may be eliminated if cofluid dispensing is not needed, and it is understood that an additional first and second fluid port can be provided if warranted by the fluids to be dispensed.

First fluid port 83 is situated to remain open and provide communication from space interjacent stem 37 and valve seat 71 to passageway bore 81. Second fluid port 85 is situated in shoulder 77 so that it will also provide a communication path to the said space interjacent stem 37 and valve seat 71 from passageway bore 81 when said valve is in a shut or intermediate operating state. In said cofluid dispensing state, port 85 is protrudingly projected into said second fluid transit chamber 47 to provide communication therefrom to passageway bore 81, and allow discharge flow of second fluid.

In said cofluid dispensing state, protrusion of shoulder 77 through central opening of gasket 65 unseats gaskets 63 and 65 from valve seat 71 by deflecting the central portion of gasket 65 downward, this allows discharge flow of first fluid through port 83 concurrently with flow of second fluid through port 85. The inrush of said fluids through their respective ports prevents either fluid from entering the opposite fluid transit chamber.

In the said intermediate operating state, said unseating of gasket 65 allows discharge flow of first fluid only through both first and second fluid ports 83 and 85. Said discharge of first fluid only, serves to remove residue from discharge passageways of stem 37 and said dispensing head 39, it also prevents inadvertent discharge of second fluid without partical breakup assistance.

The intermediate operating state can also allow use of a solvent, not shown, disposed with first fluid 13 in inner container 17. The solvent can be any appropriate fluid including said first fluid 13 that will normally remain at the bottom of container 17. To effect valve cleaning using a solvent, container 11 must be held upside down and dispensatory means 35 operated in a partially depressed position. This allows the solvent to enter the valve through first fluid orifice 51 and therefrom be discharged through said passageways of stem 37 and head 39 to remove second fluid residue.

MODIFICATION

Figure 5:
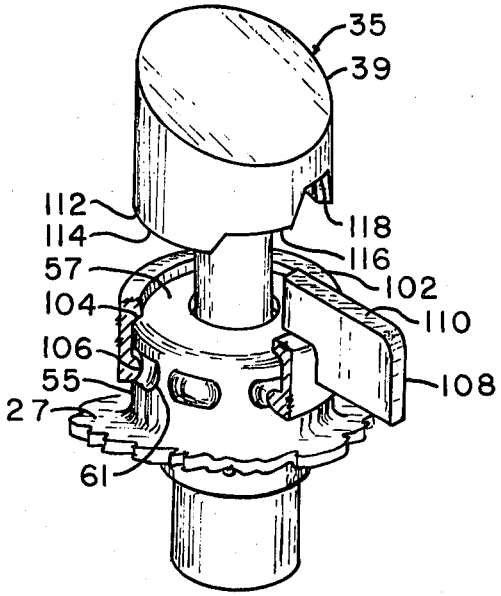

Isometrically shown in FIG. 5, is a manually rotatable position control member 102 for regulating inward movement of dispensatory actuator means 35. Control member 102 is an annular sleeve-like component that is adapted to be externally snap-fit mounted on said protrusion 55 of valve cup 27. Said member 102 is considered to be of molded plastic or formed metal having some resiliency, as seen at the broken away wall portion provided for clarity, said member 102 is provided with an inwardly turned annular shoulder 104 that is engaged with closure end 57 of protrusion 55. The lower end of member 102 has an internally formed bead 106 that resiliently engages said crimps 61 of valve cup 27. Projecting upward and radially outward from the periphery and upper end of member 102 is an indexing tab 108 that has a top surface 110. Surface 110 is provided for engagement with the bottom edge surfaces of dispensing head 39. Said tab is also provided as a means for rotational positioning of member 102 with respect to valve cup 27 and head 39, and said resilient engagement of bead 106 and crimps 61 provides a detent positioning holding means.

To accommodate use of control member 102, head 39 is tiered at its peripheral wall bottom surface 112 to provide three levels of engagement with said tab 108. The lowermost level is designated 114, the intermediate level is designated 116, and the uppermost level is represented by designation 118. The distance between each of the said levels is predicated by the amount of inward movement travel, with respect to tab surface 110, actuator 35 requires to effect each of the previously said three valve functions. In the shut state, first level 114 is situated for engagement with tab surface 110 to prevent inadvertent valve operation when valve operation is not needed. Second level 116 is situated for engagement with tab surface 110 when said valve is operated for self-cleaning. Second level 116 limits travel of actuator 35 to prevent inadvertent cofluid dispensing during cleaning. The third level 118 is situated to be indexed with tab 108 for cofluid dispensing, whereby, engagement with surface 110 is not needed. Indexing positioning of control member 102 with respect to said levels can either be effected by positioning tab 108, or by turning dispensing head 39 to the desired indexing position.

MODIFICATION

Figure 6:
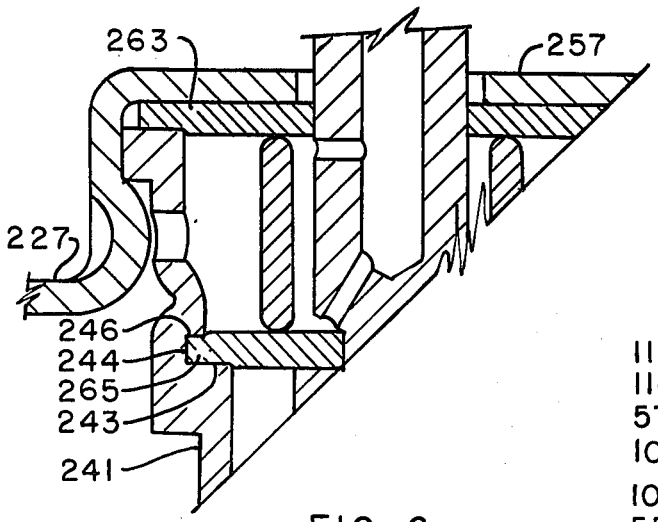
FIG. 6 is a fragmentary sectional view, of the valve, showing a construction modification.

In the valve herein previously described, spacer 67 merely serves to provide a means for sealingly securing gaskets 63 and 65 at their periphery. Other methods of securing said gaskets are envisioned, as exemplified in FIG. 6, gasket 265 is affixed in an annular groove 244 formed in housing 241 adjacent ledge 243. Affixing of gasket 265 can be accomplished in several ways, such as by bonding, or as shown by clamping at designation 246 whereas, groove 244 is caused to securingly squeeze gasket 265 against ledge 243. The clamping can be accomplished by heat forming under pressure, whereby the housing is reshaped after the gasket is in place, to form groove 244. Gasket 263 can then be clamped between the open end of housing 241 and valve cup 227 closure end 257 to prevent inadvertent leakage of first fluid past said closure end 257. Allowing for elimination of spacer 67, the valve of this modification is functionally the same as previously described.

MODIFICATION

Figure 7:
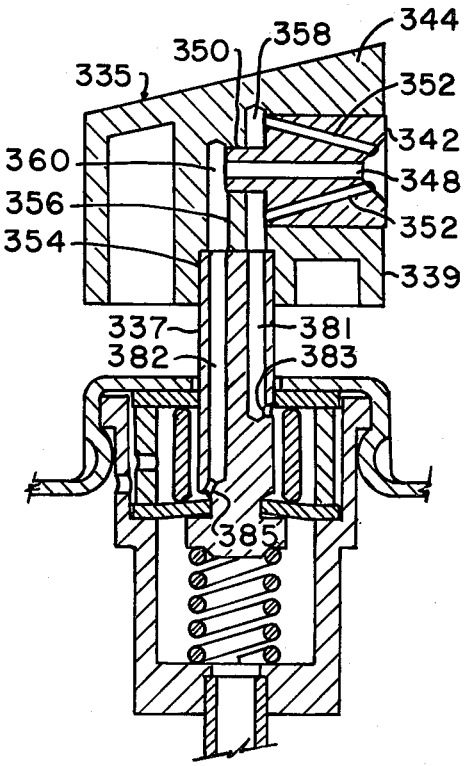

Shown in FIG. 7, a modification to dispensatory actuator means, here actuator 335 is provided in place of actuator 35. Actuator 335 is adapted to maintain separation of first and second fluids until after they are discharged. All other functions and features are unchanged from those previously described.

Actuator 335 includes a dispensing head 339 in place of head 39, and a stem 337 instead of stem 37. The only difference between stems 37 and 337 is the passageway bore all other stem features remain unchanged. To provide for fluid separation, and still provide means for particle breakup assistance, head 339 is adapted to cause external mixing of first fluid vapor and second fluid, after said fluids are discharged.

To accommodate said head 339, stem 337 is provided with separate longitudinal passageway bores in place of previously said passageway bore 81. A first fluid passageway bore 381 joins first fluid port 383 in place of port 83. A second fluid passageway bore 382 joins second fluid port 385 in place of port 85. Except for having two passageway bores, stem 337 functions in the same manner as previously described for stem 37.

Referring specifically to head 339, as seen in FIG. 7, head 339 includes a diffuser nozzle 342 and head body 344. Diffuser nozzle 342 is a cylindrical member, having a central second fluid discharge passageway 346 which has a beveled outlet 348, and a reduced diameter end projection 350. In addition, nozzle 342 includes at least two first fluid passageways 352 which are adapted to direct discharged first fluid into the path of discharged second fluid, immediately in front of head 339, to cause fine particle dispersion. Said head body is provided with with partition 356 which forms an internal first fluid chamber 358, and a second fluid chamber 360. Said chambers and partition are formed by bored holes aligned to match said stem passageway bores. Perpendicular to said 358 and 360 bores, head body 344 is step bored to receive nozzle 342. Head body also has one additional bore, 354, adapted to cooperatively engage stem 337. Nozzle passageways 346, 352, chambers 358 and 360, and stem passageways 381 and 382 are indexed to provide continuous flow for the respective first and second fluids.

MODIFICATION

Figure 8:
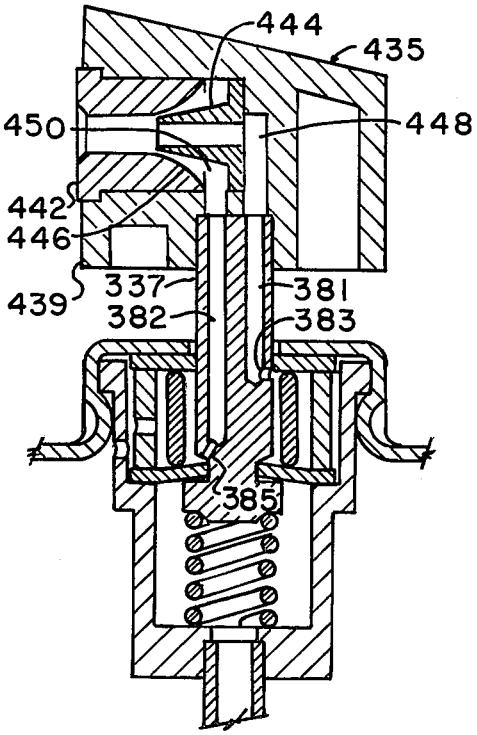
FIGS. 7 and 8 are cross-sectional views, of the valve, showing valve stem and dispensing head modifications.

A second dispensatory actuator means 435, is shown in in FIG. 8. In this modification dispensing head 439 is used in place of dispensing head 339 of the previous modification. Head 439 is adapted to utilize vacuum pressure created by outward flow of first fluid to draw second fluid into head 439 for mixing and subsequent discharge with first fluid.

Dispensing head 439 is an ejector type dispensing device that includes a diffuser 442 to mix departing fluids. Head 439 also includes a motive gas nozzle 444, and a venturi throat 446, a motive gas inlet passageway 448, and a suction chamber 450, to create a vacuum suction pressure.

While ejector type dispensing devices are not normally used for aerosols, the art is well defined in text books. The use of head 439 provides a means for dispensing second fluids that are not under pressure of a first fluid. The suction pressure is capable of drawing said second fluid into said head 439 when actuator 435 is positioned for cofluid dispensing and second fluid is allowed to flow through actuator passageways.

Head 439 is cooperatively engaged with previously said stem 337 in the same manner as previously said head 339. All other features and functions of dispensatory actuator means 435 are the same as previously described for actuator means 335, and all other valve features and functions are also as previously described.

It is thought that the invention and its advantages will be understood from the foregoing description, and it is apparent that various changes may be made in the form, construction and arrangement of the parts without departing from the spirit and scope of the invention or sacrificing its material advantages, the form hereinbefore described and illustrated in the drawings being merely a preferred embodiment thereof. Having described my invention, reference should now be had to the following claims.

I claim:

1. A self-cleaning cofluid dispensatory valve adapted to maintain separation of a first fluid from a second fluid prior to effluence, which comprises:

a housing having an upper open end first fluid transit chamber separated from a lower second fluid transit chamber;

a resilient annular sealing barrier disposed within said housing to maintain sealing separation of said chambers;

a unifier means affixed on said first fluid transit chamber to retain said valve in a definable unit;

a resilient annular gasket adapted to provide sealing closure at said open end;

a resiliently mounted dispensatory actuator means that includes an outwardly projecting, depressible, stem member that maintains slidable sealing engagement with said gasket and cooperative valvular engagement with said barrier;

an annular valve seat means fitted loosely around said stem, and positioned engagingly between said gasket and said barrier;

said valve seat being normally seated between said gasket and said barrier, and unseated by axial movement along said stem;

said stem further maintaining cooperative sealing engagement with central portions of said barrier to urge said seating and unseating and maintain sealing separation of said chambers;

said stem also including a discharge passageway that is provided with at least one fluid port and at least one second fluid port;

said ports each situated to allow first fluid discharge flow through said stem passageway when said actuator is in an intermediate operating position, whereas, said valve seat means is unseated;

said first and second fluid ports further being situated to be within respective first and second fluid transit chambers to allow concurrent flow of first and second fluids through said stem passageway when said actuator is operated to its lowermost position, for cofluid dispensing;

said valvular engagement being adapted to allow fluid flow communication between said second fluid port and said second fluid transit chamber when said actuator is operated for cofluid dispensing.

2. In the invention of claim 1, a perforated spacer interposing said gasket and said barrier adjacent their periphery to effect mounting and sealing of said gasket and said barrier.

3. In the invention of claim 1, said dispensatory actuator means including a dispensing head cooperatively depending from said stem.

4. In combination with the invention of claim 3, a position control means adapted for cooperative engagement with said dispensing head to govern operation of said actuator means.

5. A self-cleaning cofluid dispensatory valve adapted to maintain separation of a first fluid from a second fluid prior to effluence, which comprises:

a housing having an upper open end first fluid transit chamber separated from a lower second fluid transit chamber;

a resilient annular sealing barrier disposed within said housing to maintain sealing separation of said chambers;

a unifier means affixed on said first fluid transit chamber to retain said valve in a definable unit;

a resilient annular gasket adapted to provide sealing closure at said open end;

a resiliently mounted dispensatory actuator means that includes an outwardly projecting, depressible, stem member that maintains slidable sealing engagement with said gasket and cooperative valvular engagement with said barrier;

an annular valve seat means fitted loosely around said stem, and positioned engagingly between said gasket and said barrier;

said valve seat being normally seated between said gasket and said barrier, and unseated by axial movement along said stem;

said stem further maintaining cooperative sealing engagement with central portions of said barrier to urge said seating and unseating and maintain sealing separation of said chambers;

said stem also including a first fluid discharge passageway that is provided with at least one first fluid port, and a second fluid discharge passageway that is provided with at least one second fluid port;

said ports situated to allow first fluid discharge flow through said first and second fluid passageways of said stem when said actuator is in an intermediate operating position, whereas, said valve seat means is unseated;

said first and second fluid ports further being situated to be within respective first and second fluid transit chambers to allow concurrent flow of first and second fluids through respective first and second fluid passageways of said stem member when said actuator is operated to its lowermost position, for cofluid dispensing;

said valvular engagement being adapted to allow fluid flow communication between said second fluid port and said second fluid transit chamber when said actuator is operated for cofluid dispensing.

6. In the invention of claim 5, said dispensatory actuator means including a dispensing head cooperatively depending from said stem member.

7. In the invention of claim 6, said dispensing head being adapted to maintain separation of said fluids until said fluids have departed from passageways of said dispensing head.

8. In the invention of claim 7, said dispensing head being adapted to cause mixing of said departed fluids.

9. In combination with the invention of claim 6, a position control means adapted for cooperative engagement with said dispensing head to govern operation of said actuator means.

10. In the invention of claim 5, said dispensatory actuator means including a dispensing head that is adapted to utilize discharge flow of a first fluid to cause concurrent discharge flow of a second fluid.

* * * * *